United States Patent [19]

Chiu

[11] Patent Number: 5,029,916

[45] Date of Patent: Jul. 9, 1991

[54] PUSH-PULL DOOR LOCK

[76] Inventor: I-Hsin Chiu, 22 Lane 20, Chuanchow Street, Taipei, Taiwan

[21] Appl. No.: 602,615

[22] Filed: Oct. 24, 1990

[51] Int. Cl.[5] ..... E05C 1/14

[52] U.S. Cl. ..... 292/336.3; 292/170; 292/347; 292/DIG. 2

[58] Field of Search ..... 292/336.3, 347, 170, 292/182, 159, 140, DIG. 2, DIG. 37

[56] References Cited

U.S. PATENT DOCUMENTS

| | | | |
|---|---|---|---|
| 455,334 | 7/1891 | Iske et al. | 292/170 X |
| 2,726,889 | 12/1955 | Lawson | 292/170 |
| 3,582,121 | 6/1971 | Rollins | 292/170 |
| 4,101,153 | 7/1978 | Dozier | 292/336.3 X |
| 4,813,723 | 3/1989 | Anderson et al. | 292/336.3 |

*Primary Examiner*—Richard E. Moore

[57] ABSTRACT

A push-pull door lock chiefly comprising a sleeve on one side of a conventional door lock and a sleeve with a pull ring on the front edge on another side thereof, wherein two rollers are pivotally mounted in the sleeve and two protruding shafts are provided to the end of sleeve, each one neck of the conventional door lock handle is provided with an inclined slide groove to receive each one roller on the sleeve, each one thimble is provided to each one fixing ring on both sides of the conventional door lock so as to respectively install a compression spring and a stretch spring and to receive the two protruding shafts on the sleeve; therefore, a push-press handle is on the one side of door lock and a pull-open handle is on the another side thereof, and through pushing the sleeve on the one side of the conventional door lock by any one portion of the user's body or pulling the pull ring on the front of sleeve on the another side thereof by his any one finger, the sleeve actuates the door lock handle to rotate, and the lock tongue is thus retracted inwards, so that the purpose of opening the door can be achieved.

1 Claim, 1 Drawing Sheet

PUSH-PULL DOOR LOCK

BACKGROUND OF THE INVENTION

An overwhelming majority of conventional door locks may be opened through a hand to turn the handle of lock or a key to open the heart of lock, so that the tongue of lock is retracted to disengage from the catch on the door frame. However, these conventional door locks are considerably inconvenient for some people or in some circumstances. For instance:

1. The people who suffer apoplexy or broken arms cannot use their arm strength or have no arms to use, so they always cannot open the rotary door lock in general and the most popular trumpet lock in particular. If they leave from or enter into the room, they have to wait for someone else coming to open the door lock for them; otherwise, they cannot unlock it, this is extremely inconvenient for them.

2. When we carry a heavy object or hold something with two hands and intend to pass through or enter into the door equipped with the said lock, since these two hands are occupied and thus cannot open the door, so we have to put down the said heavy object or something on the floor in order to use a hand to turn the handle or heart of lock, then we may carry the heavy object or something to pass through the door. This is extremely troublesome and inconvenient for the people at large who complain about it very much.

In view of the above, the present inventor, through his research and development, invented a "push-pull door lock" of the present invention which can fully eliminate the foregoing drawbacks of conventional locks.

SUMMARY OF THE INVENTION

The object of the present invention is chiefly to offer a "push-pull door lock" which is characterized by a push-press handle on the one side of door lock and a pull-open handle on the another side thereof, so that the disabled people or we normal people while carrying heavy objects or hold a number of articles, can easily unlock the door only through a certain part of human body to push it or through a hand to pull it.

Figure 1:
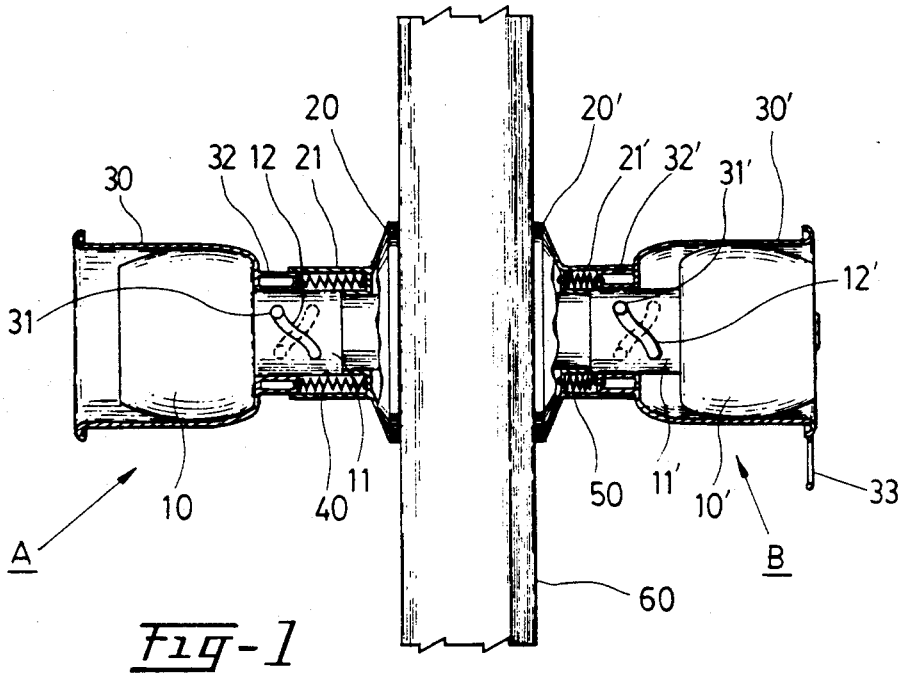
FIG. 1 is a schematic section view of the present invention.

A . . . push-press handle
B . . . pull-open handle
10 . . . conventional door lock handle
10'. . . conventional door lock handle
11 . . . handle neck
11'. . . handle neck
12 . . . inclined slide groove
12'. . . inclined slide groove
20 . . . conventional door lock fixing ring
20'. . . conventional door lock fixing ring
21 . . . thimble
21'. . . thimble
30 . . . sleeve
30'. . . sleeve
31 . . . roller
31'. . . roller
32 . . . protruding shaft

32'. . . protruding shaft
33 . . . pull ring
40 . . . compression spring
50 . . . stretch spring
60 . . . door panel

DETAILED DESCRIPTION

The structural characteristics of the present invention can be best described in detail through showing a preferred embodiment thereof in conjunction with the accompanying drawings as follows:

As shown in FIG. 1, the push-pull door lock of the present invention is comprising a push-press handle on the one side thereof and a pull-open handle on the another side thereof, wherein the push-press handle A is disposed on the opening side of door panel 60 and the pull-open handle B is disposed on the closing side of door panel.

Figure 2:
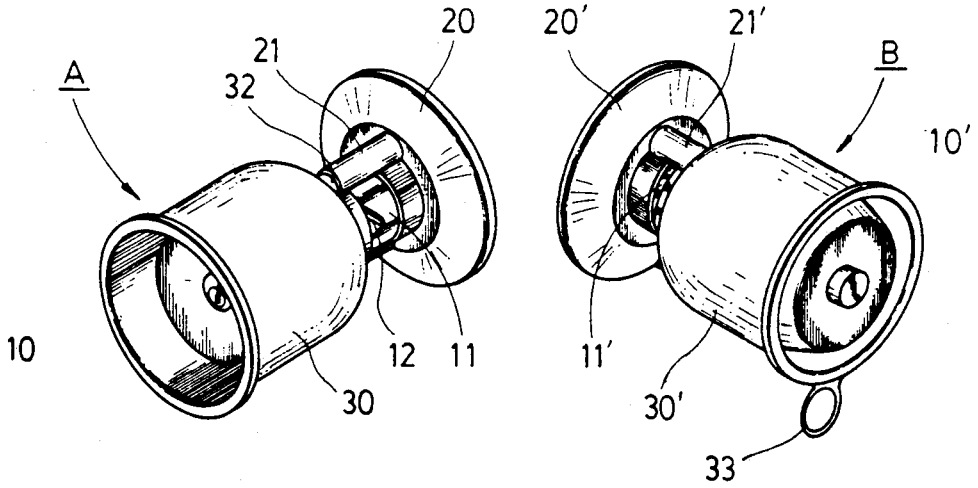
FIG. 2 is a schematic appearance view of the two ends of the present invention.

As shown in FIG. 2, so far as the push-press handle A is concerned, an inclined slide groove 12 is provided to each of two sides of the neck 11 of conventional door lock handle 10 on the one side of lock, a thimble 21 is provided to each of two sides of a fixing ring 20 on the same one side of conventional door lock, a sleeve 30 is provided to the outer side of said conventional door lock handle 10; inside one end of the sleeve 30, a roller 31 is pivotally and deeply disposed in each of the inclined slide grooves 12 on the two sides of said neck 11; outside the same one end of sleeve 30, a protruding shaft 32 is disposed in each of the thimbles 21 on the two sides of said door lock fixing ring 20; and one each compression ring 40 is mounted between the end of protruding shaft 32 and the thimble 21.

So far as the pull-open handle B is concerned, an inclined slide groove 12' is provided to each of two sides of the neck 11' of conventional door lock handle 10' on the another side of lock, a thimble 21' is provided to each of two sides of a fixing ring 20' on the same one side of conventional door lock, a sleeve 30' is provided to the outer side of said conventional door lock handle 10'; inside one end of the sleeve 30', a roller 31' is pivotally and deeply disposed in each of the inclined slide grooves 12' on the two sides of the neck 11'; a pull ring 33 is provided to one side of front edge of said sleeve 30'; outside the same one end of sleeve 30', a protruding shaft 32' is disposed in each of the thimbles 21' on the two sides of said door lock fixing ring 20'; one each stretch spring 50 is mounted between the end of protruding shaft 32' and the thimble 21'; one end of the stretch spring 50 is fixed onto the end of protruding shaft 32', and another end of the stretch spring 50 is fixed onto the bottom end of said thimble 21'.

Through the foregoing structure, when someone intends to enter into (or leave from) the room from the side of push-press handle A by means of unlocking the door lock, if nothing is on his hand, he may use his hand to slightly push and press the sleeve 30; if his two hands are occupied or in case of a disabled man without arms, he may use his body to push and press the sleeve 30; the purpose of unlocking the lock can be achieved. When the sleeve 30 is pushed and pressed, the two protruding shafts 32 thereof will slide inwards along the two thimbles 21 to press and retract the compression spring 40, and the two rollers 31 thereof will actuate the handle neck 11 (i.e. the handle 10 as a whole) to rotate about 90° through the inclination of slide groove 12, and such a rotation can actuate the lock tongue of the door lock to retract inwards so as to achieve the purpose of opening the door (panel) 60 which will open along our thrust so that we can enter into the room. After the force to push and press the sleeve 30 is released, the sleeve 30 is subject to the elastic force of compression spring 40 to slide back to its original position and to let the handle 10 return to its original position.

When someone intends to leave from (or enter into) the room from the side of pull-open handle B by means of unlocking the door lock, if nothing is on his hand, he may use his hand to slightly pull the sleeve 30'; if his two hands are occupied, he may use his either one hand to close to the door lock and use any one most convenient finger of him to pull the pull ring 33 on the lateral edge of sleeve 30' outwardly; the purpose of unlocking the lock can be achieved. When the sleeve 30' is subject to the outward pull, the two protruding shafts 32' thereof will slide outwards along the two thimbles 21' to stretch the stretch spring 50, and the two rollers 31' thereof will actuate the handle neck 11' (i.e. the handle 10' as a whole) to rotate about 90° through the inclination of slide grooves 12', and such a rotation can actuate the lock tongue of door lock to retract inwards so as achieve the purpose of opening the door (panel) 60 which will open along our pull so that we can leave from the room. After the force to pull the sleeve 30' is released, the sleeve 30' is subject to the retractive elastic force of compression spring 50 to slide back to its original position and to let the handle 10' return to its original position.

The present invention is chiefly related to a design of structure added to the outer sides of two handles of door lock in general but such structure as the lock art, lock tongue and drive lever inside the lock remains unchanged, so the locking and unlocking functions of door lock still exist. When to lock the door or open it with a key, all that is needed to do is only to insert the key in the hollow part of sleeve 30, 30' to reach the lock heart in the handle 10, 10' so as to achieve the purpose of opening the door or unlocking the door lock.

In view of the above, the novel push-press and pull-open structure of the present invention to unlock the door lock can benefit the disabled people and eliminate our trouble of inconveniently opening the door in a certain special condition, so it is replete with novelty, advancement and practical value.

I claim:

1. A push-pull door lock consists of a push-press handle provided to one side of a conventional door lock and a pull-open handle provided to another side thereof, wherein:

the push-press handle comprising:

a sleeve, of which the interior is provided with two rollers pivotally, and the end is provided with two protruding shafts;

a handle on one side of the conventional door lock, of which the neck is provided with an inclined slide groove in keeping with each one position of the rollers on the sleeve so that the roller can be inserted in the slide groove;

a fixing ring on one side of the conventional door lock, which is provided with two thimbles in keeping with each one protruding shaft on the sleeve so as to receive the protruding shafts; and two compression springs, which are respectively disposed between the two thimbles on the fixing ring and the two protruding shafts on the sleeve; and the pull-open handle comprising:

a sleeve, of which the front edge is provided with a pull ring, the interior is provided with two rollers pivotally, and the end is provided with two protruding shafts;

a handle on another side of the conventional door lock, of which the neck is provided with an inclined slide groove in keeping with each one position of the rollers on the sleeve so that the roller can be inserted in the slide groove;

a fixing ring on another side of the conventional door lock, which is provided with two thimbles in keeping with each one protruding shaft on the sleeve so as to receive the protruding shafts; and two stretch springs, which are respectively disposed between the two thimbles on the fixing ring and the two protruding shafts on the sleeve, and of which one end is fixed onto the thimbles and another end is fixed onto the protruding shafts; and through pushing the sleeve on the one side of the conventional door lock by any one portion of the user's body or pulling the pull ring on the front edge of sleeve on the another side thereof by his any one finger, the sleeve actuates the door lock handle to rotate, and the lock tongue is thus retracted inwards, so that the purpose of opening the door can be achieved.

* * * * *